United States Patent [19]

Garfield et al.

[11] Patent Number: 4,926,039

[45] Date of Patent: May 15, 1990

[54] STREAKING OR FRAMING IMAGE TUBE WITH PLURAL GRID CONTROL

[75] Inventors: Brian R. C. Garfield, Basildon; Mark J. Riches, Basildon, both of Great Britain

[73] Assignee: Imco Electro-Optics Limited, United Kingdom

[21] Appl. No.: 266,411

[22] Filed: Nov. 2, 1988

[30] Foreign Application Priority Data

Nov. 4, 1987 [GB] United Kingdom ..... 8725856

[51] Int. Cl.[5] ..... H01J 31/50

[52] U.S. Cl. ..... 250/213 VT; 313/529

[58] Field of Search ..... 250/213 VT; 313/528, 313/529, 532, 537

[56] References Cited

U.S. PATENT DOCUMENTS

| | | | |
|---|---|---|---|
| 3,733,493 | 5/1973 | Hagar | 250/213 VT |
| 4,323,811 | 4/1982 | Garfield | 313/529 |
| 4,740,685 | 4/1988 | Koishi | 250/213 VT |
| 4,801,796 | 1/1989 | Kinoshita et al. | 250/213 VT |

FOREIGN PATENT DOCUMENTS

| | | |
|---|---|---|
| 1458399 | 12/1976 | United Kingdom . |
| 2171553 | 8/1986 | United Kingdom . |

*Primary Examiner*—David C. Nelms

*Attorney, Agent, or Firm*—Jenner & Block

[57] ABSTRACT

A streaking or framing image tube includes a photocathode (4), three grid electrodes (1, 2 and 3), a focus electrode (5) and an anode (6) disposed successively along the image tube. The tube is gated by applying a positive voltage pulse first to the second grid electrode (2) and then to the photocathode (4), the delay time between the application of the pulse to the second grid and the photocathode being the gated "on" time of the image tube, while during the application of the pulse to the second grid electrode (2) and the photocathode (4), the potentials of the first and third grid electrodes (1, 3) are held constant at a constant value, and accordingly ultra high speed gating (e.g. allowing the passage of electrons for less than $10^{-9}$ seconds) can be achieved without effect on the magnification or resolution performance of the image tube.

10 Claims, 2 Drawing Sheets

STREAKING OR FRAMING IMAGE TUBE WITH PLURAL GRID CONTROL

FIELD OF THE INVENTION

This invention relates to electron optical image tubes of the type known as streaking or framing image tubes, and more particularly to the gating of such image tubes.

A streaking or framing image tube normally includes an electrode assembly for forming a focussed image on the screen of the tube, the electrode assembly normally includes one or more focus electrodes which by application of the appropriate potential(s), shapes the electric field between photocathode and anode in such a way so as to produce a correctly focussed image.

The invention is particularly although not exclusively intended for streaking or framing image tubes in which the image on the screen is inverted relative to the optical image applied to the photocathode.

BACKGROUND TO THE INVENTION

British Patent Specification No. 1 458 399 (English Electric Valve Company Limited) describes a streaking or framing image tube in which two mesh electrodes are interposed between the photocathode and the focussing electrode.

In British Patent Specification No. 2 171 553 A (Hadland Photonics Limited, inventor Alexander E. Huston) a method of gating such a two mesh streaking or framing image tubes is described. According to Huston the method comprises raising and lowering the potential of the first grid, which is closest to the photocathode, over a short interval of time, to gate the electron beam on and off over the said interval, the second grid being held at a constant potential chosen so that the focussing conditions for the image tube are satisfied.

SUMMARY OF THE INVENTION

According to the invention there is provided a method as claimed in each of claims 1 to 6, a streaking or framing image tube as claimed in each of claims 7 to 9 and the combination of the streaking or framing image tube with means as claimed in each of claims 10 to 13.

It is believed possible by means of the invention to gate an electron beam in such an image tube on and then off extremely quickly, so that the beam is of extremely short duration.

DESCRIPTION OF PREFERRED EMBODIMENT

(1) General Description Of Image Tube and Circuitry

Figure 1:
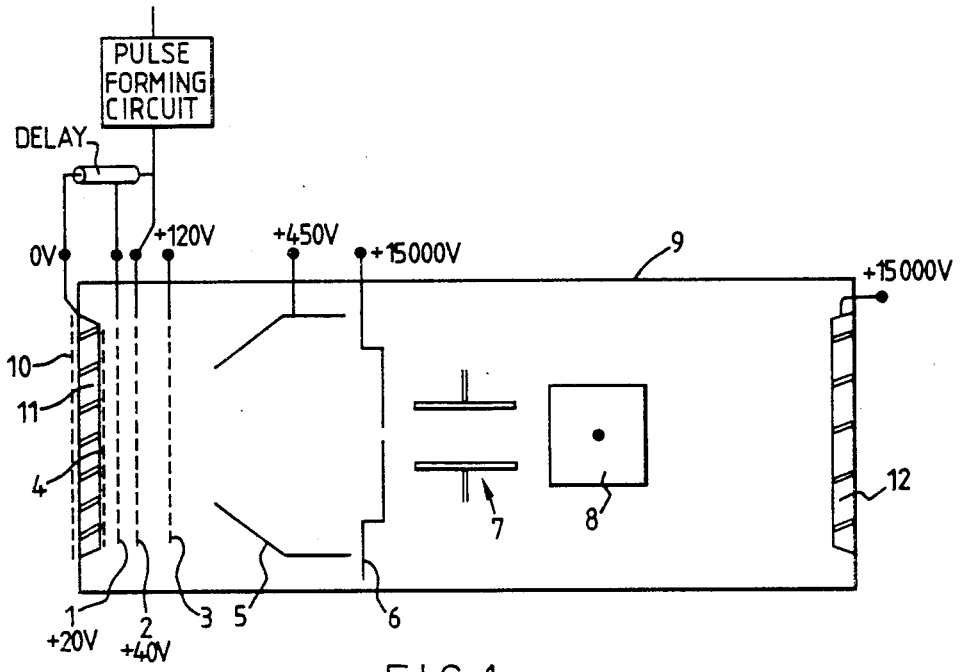
FIG. 1 is a diagram of a streaking or framing image tube and some associated circuitry embodying the invention.

The streaking or framing image tube is constructed so that it has three "grid" electrodes disposed between the photocathode and the focus electrode assembly as shown in FIG. 1.

Figure 2:
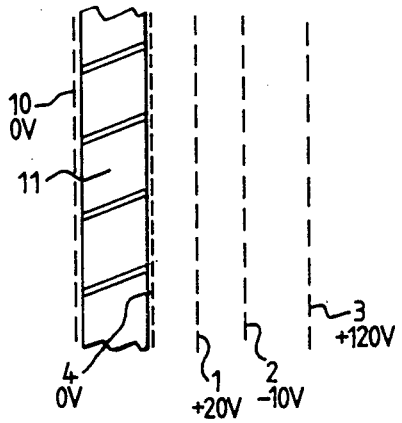
FIG. 2 is an enlargement of part of the tube of FIG. 1.

The tube is regarded as operated in the "normal gated off" or "standby" mode when the potentials are as indicated in FIG. 2. In this situation electrons which are emitted from the photocathode 4 and pass through "grid" electrode 1 are returned to "grid" electrode 1 by the influence of the electric field between "grid" electrodes 1 and 2.

The image tube is "gated on" by the application of a voltage pulse to "grid" electrode 2 such that during the duration of the pulse the potential of "grid" electrode 2 is sufficiently greater than that of photocathode 4 such that electrons emitted from photocathode 4 which pass through "grid" electrode 1 can now pass through "grid" electrodes 2 and 3 to reach the screen 12.

The image tube is "gated off" by applying to the photocathode 4 an identical or at least very similar voltage pulse to that used to "gate" on the tube so that during the duration of the pulse the potential of the photocathode 4 is held at a value about that of "grid" electrode 1 such that electrons emitted from the photocathode 4 are returned to photocathode 4 by the action of the retarding field between photocathode 4 and "grid" electrode 1.

The "grid" electrode 1 is held at a constant potential during all the modes of tube operation. Likewise "grid" electrode 3 is held at a constant potential during all the modes of tube operation, the potential being that required for optimum focus of the electron image on the screen.

Figure 3:
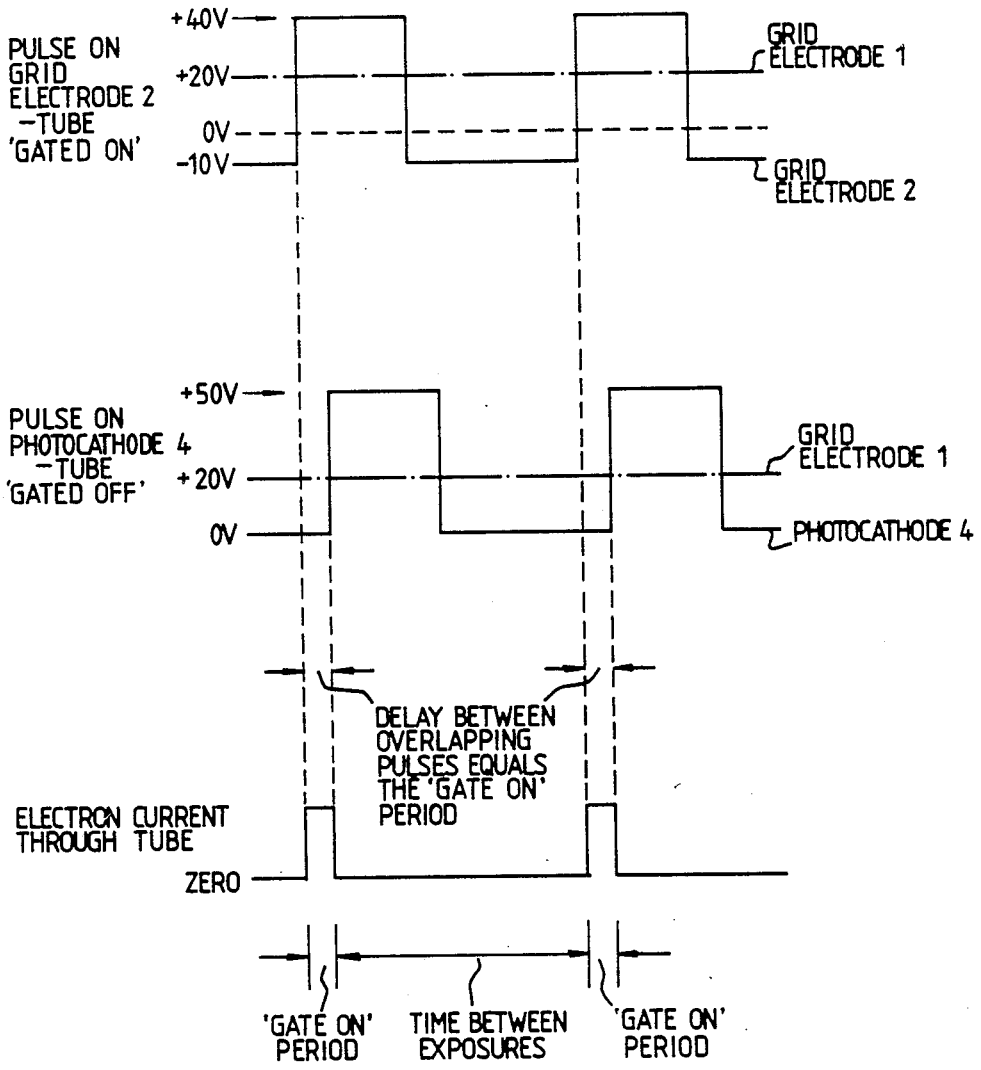
FIG. 3 is a voltage pulse/time chart illustrating operation of the embodiment of FIGS. 1 and 2.

The action of the voltage pulses in gating the image tube on and off can be seen by reference to FIG. 3. In FIG. 3 typical operating potentials are indicated including a 50 V amplitude for the applied voltage pulses.

From FIG. 3 it is apparent that repetitive gating on and off of the photocathode emission current can be achieved by two trains of overlapping voltage pulses, one applied to grid electrode 2 and the other to the photocathode 4. It is also apparent from the arrangement described in FIG. 3 that the gate "on" (or frame exposure) time is equivalent to the time delay between the pulses applied to grid electrode 2 and the photocathode 4.

It will also be apparent to those skilled in the art that if grid electrode 2 and the photocathode 4 are connected by a delay circuit (e.g. transmission line) then the application of one pulse train to the "grid" electrode 2 can effect the arrangement as shown in FIG. 3.

The advantages of the method described here are:

1. An accurately specified gating pulse corresponding to the exposure duration is no longer required as the delay between the gating pulses applied to "grid" electrode 2 and the photocathode 4 determine the gate "on" period. The gating pulse is of course required to have a fast rise time but the full time and exact pulse shape is not critical.

2. The gate "on" period is independant of the period of the gating pulse and, for very short gate "on" periods, e.g. 1 n sec (one nano-second) or less, the gate period is readily controlled by a length of transmission line e.g. 1 n sec corresponds approximately to use of 10 cm length of transmission line (assuming group velocity of $10^8$ metres/second).

3. Because of 2, there is no difference in the gate "on" period between different frames in a sequence.

(2) Detailed Description of Image Tube

FIG. 1 illustrates the streaking or framing image tube diagrammatically. All potentials are specified relative to photocathode 4.

The image tube components are incorporated into a vacuum envelope 9. The photocathode 4 is formed on the inside surface of the glass faceplate 11 whilst a semitransparent conducting electrode 10 is deposited on the outer surface of the faceplate 11 and connected electrically to photocathode 4 to ensure that capacitative charging effects within the glass faceplate are avoided during gating of the photocathode 4. First, second and third "grid" electrodes, 1, 2 and 3, preferably in the form of meshes, are arranged so that electrons from the photocathode must transverse all three electrodes on their passage down the tube. Included in the tube is a focus electrode 5 and anode 6. The image tube would normallY include deflector plates 7 and 8 as shown. The tube also includes a phosphor screen 12. The tube may be of the construction as described in GB-PS-1458399.

Potentials shown in FIG. 1 are typical for the correct focussing of the tube although exact values will depend on the particular design of tube used.

During operation of the image tube it is desirable that the potentials applied to grid electrodes 1 and 2 be kept to a minimum to ease the requirements of the gating circuitry. Also, to ensure that disturbance to the focus conditions is minimised the grid electrodes 1 and 2 should be operated at the equipotential values corresponding to the field between the photocathode 4 and grid electrode 3. Both above requirements militate for grid electrodes 1 and 2 being close spaced to the photocathode 4 with their construction being of fine mesh wire with a high transmission for electrons. The grids may be geometrically arranged to form a transmission line structure to ease high speed electronic operation.

The prefered situation is as below:

spacing-photocathode to grid electrode 3—3 mm
spacing-photocathode to grid electrode 1—0.5 mm
spacing-photocathode to grid electrode 2—1.0 mm With a typical focus potential of 120 V on grid electrode 3 corresponding potentials for grid electrodes 1 and 2 of +20 V and +40 V respectively are adopted.

The mesh of the grid electrodes 1, 2 and 3 are of 1000 mesh/inch with a transmission for electrons of greater than 70%.

We claim:

1. A method of gating a streaking or framing image tube which includes a photocathode, an electrode assembly for forming a focussed image on a screen and first, second and third grid electrodes disposed successively along the image tube between the photocathode and the said electrode assembly, said method comprising:

raising the potential of the second grid electrode to allow the passage of electrons beyond the second grid electrode followed by raising the potential of the photocathode to stop the passage of electrons to the second grid electrode.

2. A method as claimed in claim 1, wherein said raising of the potentials on the photocathode and second grid electrode is achieved or facilitated by the application of a train of positive voltage pulses to the second grid electrode and then to the photocathode by means of a delay circuit connected between the second grid electrode and the photocathode.

3. A method as claimed in claim 1, wherein the first and third grid electrodes are maintained at constant potentials such that variations in the potentials of the photocathode and the second grid electrode during the gating sequence does not disturb the focussing electric field conditions produced by the electrode assembly.

4. A method as claimed in claim 1, wherein the first, second and third grid electrodes are spaced approximately 0.5, 1.0 and 3.0 mm respectively from the photocathode.

5. A method as claimed in claim 1, wherein the first, second and third grid electrodes are substantially 1000 mesh per inch with an optical transmission of greater than 70%.

6. A method as claimed in claim 1 wherein during the gated on mode the first and second electrodes are operated at potentials corresponding to equipotential values as determined by the electric field between the photocathode and the third grid electrode in the effective or notional absence of the first and second grid electrodes.

7. A streaking or framing image tube comprising a photocathode, an electrode assembly for forming a focussed image on a screen, first, second, and third grid electrodes disposed successively along the image tube between the photocathode and said electrode assembly and means adapted to operate in use by raising the potential of the second grid electrode to allow the passage of electrons beyond the second grid electrode and then raising the potential of the photocathode to stop the passage of electrons to the second grid electrode.

8. The combination as claimed in claim 7, wherein said means comprises a delay circuit connected between the second grid electrode and the photocathode, and means to cause the application of a train of positive voltage pulses to the second grid electrode and then via the delay circuit to the photocathode.

9. The combination as claimed in claim 7 wherein said means is adapted to maintain the first and third grid electrodes at constant potentials such that variations in the potentials of the photocathode and the second grid electrode during the gating sequence does not disturb the focussing electric field conditions produced by the electrode assembly.

10. The combination as claimed in claim 7 wherein said means is adapted to operate so that, during the gated on mode, the first and second electrodes are operated at potentials corresponding to the equipotential values as determined by the electric field between the photocathode and the third grid electrode in the effective or notional absence of the first and second grid electrodes.

* * * * *